United States Patent [19]

Coleman et al.

[11] Patent Number: 4,490,131

[45] Date of Patent: Dec. 25, 1984

[54] METHOD OF MAKING BAGS

[75] Inventors: Robert L. Coleman, Holland; Charles F. Schneider, Brookhaven, both of Pa.

[73] Assignee: Emanuel S. Kardon, Melrose Park, Pa.

[21] Appl. No.: 383,710

[22] Filed: Jun. 1, 1982

[51] Int. Cl.[3] ..... B31B 19/26

[52] U.S. Cl. ..... 493/217; 493/256; 493/260; 493/327; 493/450

[58] Field of Search ..... 53/372; 493/213, 217, 493/219, 260, 326, 327, 342, 373, 418, 450, 929, 256; 83/862, 863

[56] References Cited

U.S. PATENT DOCUMENTS

| | | | |
|---|---|---|---|
| 2,496,796 | 10/1947 | Kardon | 493/217 X |
| 2,709,549 | 5/1955 | Haslacher | 493/217 X |
| 2,762,272 | 9/1956 | Taylor et al. | 493/418 X |
| 3,401,608 | 9/1968 | Labombarde | 493/326 X |
| 3,943,833 | 3/1976 | Brockmüller | 493/217 |
| 4,308,021 | 12/1981 | Achelpohl | 493/342 X |

FOREIGN PATENT DOCUMENTS

| | | | |
|---|---|---|---|
| 1043785 | 11/1958 | Fed. Rep. of Germany | 493/326 |
| 353123 | 7/1931 | United Kingdom | 493/217 |

*Primary Examiner*—R. L. Spruill
*Assistant Examiner*—Steven P. Weihrouch

[57] ABSTRACT

A method of making bags of the automatic or self-opening satchel-bottom type having an outer sheet of paper and a plastic inner liner in which a tab portion is formed with a portion of the inner liner removed so that when the bag bottom is formed a paper surface of the tab portion can be adhered to a paper portion of a diamond fold when the bag bottom is completed.

1 Claim, 8 Drawing Figures

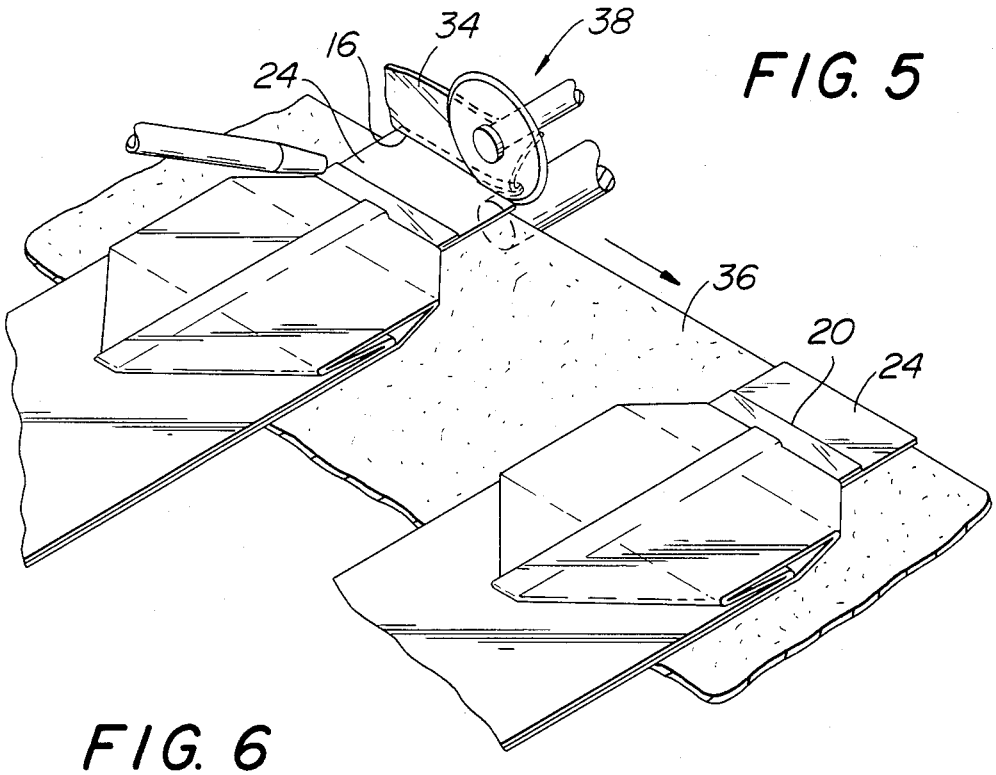
FIG. 5
FIG. 6
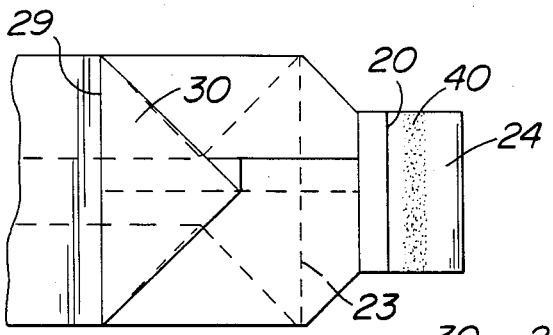
FIG. 8
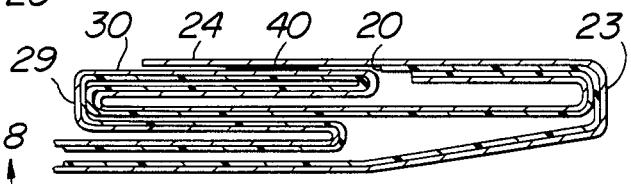
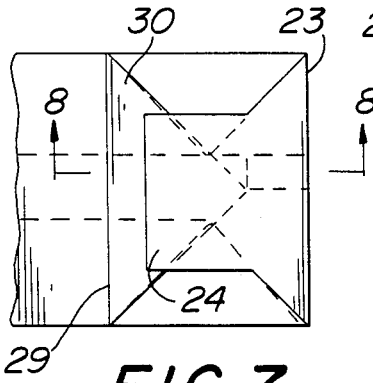
FIG. 7

METHOD OF MAKING BAGS

BACKGROUND AND SUMMARY OF THE INVENTION

This invention relates to a method of making bags and relates more specifically to a method of forming the bottom of a bag of the automatic or self-opening satchel-bottom type.

The invention relates specifically to bags of the indicated type that comprise an outer sheet of paper and an inner liner of an impervious material such as a plastic (synthetic resin). In the conventional method of making bags of the indicated type, a tube is formed having an outer sheet of paper and an inner liner. The bottom end of the bag is formed into a diamond fold with a tab portion at one end thereof. After the diamond fold and the tab portion are sealed, the bottom of the bag is completed by folding over the tab portion onto a previously folded over diamond fold portion. However, this last step requires that the inner liner of the tab portion be adhered to the paper surface of the diamond fold. The adhering of the plastic liner material to the paper outer sheet material is difficult to achieve consistently.

In accordance with the method of the invention a part of the liner is removed during the bag making method so as to permit the application of adhesive to a part of the bag such that a paper contact is achieved between the tab portion and the diamond fold portion during the last step in the bag bottom formation. More specifically, during the formation of the tube from which the bag is made, a rectangular portion near the bottom edge of one side wall is not adhered together and a slit is formed in the liner in this rectangular area extending parallel to the bottom edge and spaced therefrom. In accordance with the method of the invention, the liner portion between the slit and the bottom edge of the bag is removed to provide a paper surface which can be adhered to the paper portion of the diamond fold when the bag bottom is completed. This permits a better adhesive bond to be achieved during the bottom formation of the bag since the bond is produced by paper-to-paper contact.

BRIEF DESCRIPTION OF THE DRAWINGS

FIG. 5 is a perspective view illustrating a further step in the method of the invention.

FIG. 6 is a plan view of a still further step in the formation of the bag bottom.

FIG. 7 is a plan view illustrating the bottom of the bag in its completed form.

FIG. 8 is an enlarged section taken on line 8—8 of FIG. 7.

DETAILED DESCRIPTION OF THE PREFERRED EMBODIMENT

Figure 1:
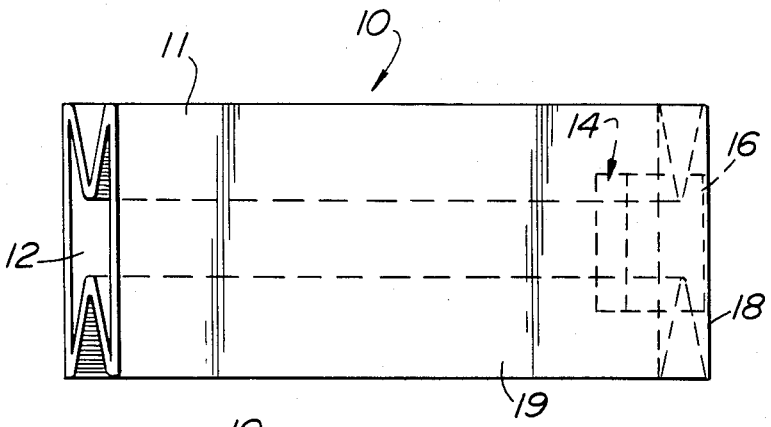
FIG. 1 is a perspective view of a bag tube illustrating a step in the method of the invention.

The method of the invention is similar to that shown and described in U.S. Pat. No. 2,496,796, the essential difference being the manner in which the tab portion is formed, namely, with a part of the inner liner thereof removed. As is described in said patent, the first step in the making of the bag is to form a tube, indicated at 10 in FIG. 1, having an outer sheet of paper 11 and an inner liner 12 of an impervious, heat-sealable plastic (synthetic resin) whereby the bag may be sealed against outside air and moisture by heat sealing the liner 12 in the manner described in said patent. The tubing forming step is performed on a conventional automatic bag making machine wherein the outer sheet 11 of the bag and the inner liner sheet 12 are fed from rolls into overlaping relation and then folded together and cut into a tube 10 of the bellows-fold type shown in FIG. 1. During this tube forming procedure, the inner liner 12 is sealed onto the inner surface of the outer sheet 11 to provide a impervious bag construction.

Figure 2:
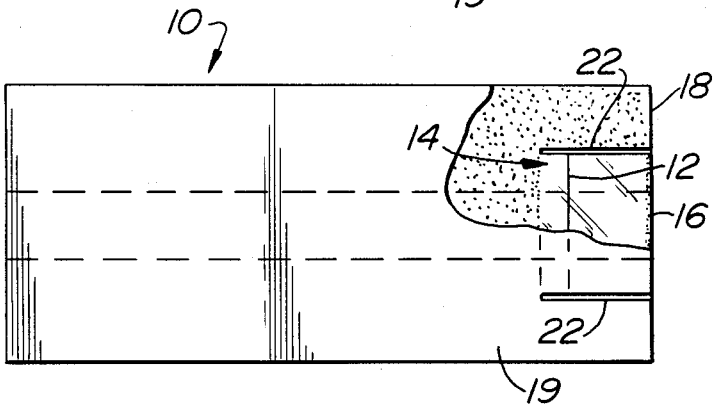
FIGS. 2, 3 and 4 are plan views of the bag tube illustrating a subsequent step in the method of the invention.

In accordance with the invention, the conventional bag tube forming step is modified in two ways. Firstly, a rectangular area 14 on one tube wall near the end which is to form the bottom of the bag is not adhered to the outer sheet. Area 14 extends inwardly from a line 16 just inside the bottom edge 18 of one side 19 of tube 10. The liner 12 is adhered to the outer sheet 11 along the strip between line 16 and the bottom edge 18. In addition, a slit 20 is cut into the inner liner 12 at a location extending parallel to the bottom edge 18 and extending across the non-adhered rectangular area 14 as is shown in FIGS. 1 and 2. Preferably, slit 20 is formed in the liner 12 immediately after the liner 12 and outer sheet 11 are brought into overlaping relation and prior to any folding steps of the tube forming operation.

Figure 3:
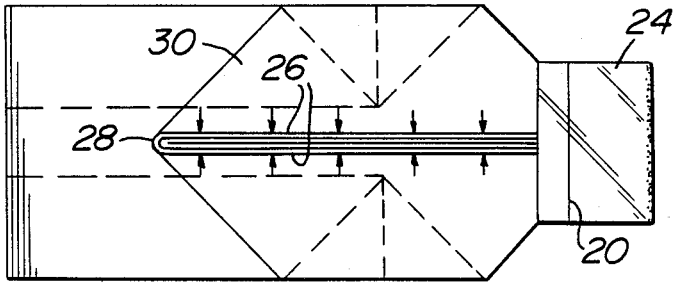
Figure 4:
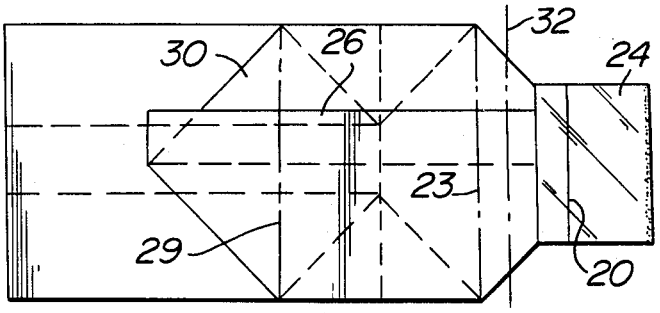

The next sequence of steps are essentially identical to that described in U.S. Pat. No. 2,496,796 and are shown in FIGS. 3 and 4. As is described in said patent, a pair of spaced apart, parallel slits 22 are formed at the bottom of the side 19 of the tube 10. The slits 22 extend longitudinally from the bottom edge 18 of the side 19 of tube 10 and are spaced equidistantly from the longitudinal edges of the side 19. Pursuant to the invention, slits 22 extend within the non-adhered rectangular area 14. It is noted that the slits 22 extend through both the outer sheet 11 and the liner 12 and thus provide a double-ply tab portion 24.

The next step of the method is to form the bottom end of the tube into a diamond fold as shown in FIG. 3 with the tab portion 24 located at one end, a triangular portion 30 at the other end, and providing upwardly extending flaps 26 at the center of the fold. The outer faces of flaps 26 are comprised of a portion of the outer sheet 11 which has a two-ply thickness of sealable lining therebetween. Flaps 26 are united by a vertical fold 28 which is at the apex of the inner triangular portion 30 of the diamond fold. By this construction there will be no opening in this area when the bottom of the bag is sealed as will be described hereafter.

While the bottom of the bag is being folded into the position shown in FIG. 3 heat is applied at right angles to flaps 26 as shown by the arrows in FIG. 3. The heat is applied in an amount necessary to cause opposing faces of the liner portions within flaps 26 to adhere to each other and thereby seal the entire length thereof. Flaps 26 are then folded into the position shown in FIG. 4 and lie flush with the plane of the formed portion of the bag bottom. While the bag is in this condition as shown in FIG. 4, heat is applied across the protruding tab portion 24 of the bag bottom along the transverse line 32 which is located between tab portion 24 and the crease line 23 upon which the final fold of the bottom portion will be made.

In accordance with a novel aspect of the present method, the next step is to remove from the tab portion 24 the portion of the liner between the slit 20 and the end thereof. This step is achieved as illustrated in FIG. 5 and comprises the application of a blast of air against the liner portion 34 to be removed so as to maintain the same in a generally upright condition as the bag is being fed along a conveyor 36 in the direction shown by the arrow in FIG. 5. The lower end of the upright liner portion 34 remains adhered to tab portion 34 at the strip along the line 16. With the liner portion 34 in this upright position, the bag is passed through a cutting station 38 whereat the edge of the tab portion 24 is cut off just inside line 16 to remove the liner portion 34 therewith providing a bag wherein the tab portion 24 has no liner in the area extending inwardly from the edge thereof to the location of slit 20.

The next step in the method is to apply a strip of adhesive 40 to the inner surface of the tab portion 24, this step being illustrated in FIG. 7. The adhesive may be applied by an adhesive applying means as illustrated in U.S. Pat. No. 3,672,328.

In the final step of the invention, the triangular portion 30 of the diamond fold bottom is bent over along the crease line 29 after which the bottom portion with the tab portion 24 extending therefrom is folded over along crease line 23 onto the triangular portion 30 to complete the formation of the bag bottom. As shown in FIG. 8, the tab portion 24 is caused to adhere to the bottom of the bag at triangular portion 30 by means of a paper-to-paper contact with an adhesive bond at strip 40 therebetween. This permits a better adhesive bond to occur as compared with a bond between paper and a plastic material as in the case with the prior art bags.

We claim:

1. A method of making a bag of the automatic or self-opening satchel-bottom type comprising the steps of:

forming a tube having an outer sheet of paper and an inner liner of impervious material with the liner being adhered to the outer sheet substantially throughout the mating surfaces thereof and being nonadhered in a rectangular area on one tube wall near the bottom end of the tube, said rectangular area extending from a line just inside the edge of the bottom end of the tube, the liner being adhered to the outer sheet along a strip portion between said line and the edge of the bottom end of the tube, said tube forming step including the step of forming a slit in the liner extending across said rectangular area and parallel to the edge of said bottom end of the tube, forming a pair of spaced apart parallel slits in said one tube wall extending inwardly from said edge and within said rectangular area to provide a rectangular tab portion, forming the bottom end of the bag into a diamond fold with the tab portion at one end thereof and a triangular portion at the other end thereof, sealing the diamond fold along an apex thereof and along an area adjacent said tab portion to completely seal the bottom end of the bag, folding the diamond fold downwardly into a flat condition, removing from said tab portion the portion of the liner in said rectangular area between the slit and said edge of said bottom end of said tube, folding over the triangular portion of said diamond fold opposite said tab portion into a flat condition, applying adhesive to the inner surface of said outer sheet of paper on an area of said tab portion from which the liner was removed, and adhering the tab portion to the folded over triangular portion of said diamond fold portion to complete the formation of the bottom of the bag, said step of removing the liner from the tab portion including the step of blowing air against said liner portion in the direction toward said bottom end edge to maintain the liner portion in a generally upright position out of contact with the adjacent portion of the outer sheet while being held at said strip portion and severing the outer edge of the bag inside said line to remove the liner portion and strip portion therewith leaving an area of paper outer sheet only.

* * * * *